US008434711B2

(12) United States Patent
Berman et al.

(10) Patent No.: US 8,434,711 B2
(45) Date of Patent: May 7, 2013

(54) UNGUIDED MISSILE AND PROJECTILE DEFENSE SHIELD SUPPORTED BY TETHERED BALLOONS

(75) Inventors: Joel F. Berman, North Hollywood, CA (US); John W. Montgomery, Houston, TX (US)

(73) Assignee: Joel F. Berman, North Hollywood, CA (US)

( * ) Notice: Subject to any disclaimer, the term of this patent is extended or adjusted under 35 U.S.C. 154(b) by 620 days.

(21) Appl. No.: 12/505,200

(22) Filed: Jul. 17, 2009

(65) Prior Publication Data

US 2011/0174922 A1 Jul. 21, 2011

Related U.S. Application Data

(60) Provisional application No. 61/141,868, filed on Dec. 31, 2008.

(51) Int. Cl.
*B64B 1/52* (2006.01)

(52) U.S. Cl.
USPC ..... 244/33; 244/110 C; 89/1.11

(58) Field of Classification Search ..... 244/24, 244/33, 110 C, 127; 89/1.11
See application file for complete search history.

(56) References Cited

U.S. PATENT DOCUMENTS

| | | | | |
|---|---|---|---|---|
| 1,309,391 | A * | 7/1919 | Adkins | 102/409 |
| 2,354,754 | A | 8/1944 | Irwin | |
| 2,365,778 | A * | 12/1944 | Schwab | 89/1.11 |
| 2,374,261 | A | 4/1945 | Ames | |
| 3,229,290 | A | 1/1966 | Fisher | |
| 3,454,244 | A | 7/1969 | Walander | |
| 5,583,311 | A | 12/1996 | Rieger | |
| 6,588,702 | B2 | 7/2003 | Robbins | |
| 6,626,077 | B1 | 9/2003 | Gilbert | |
| 6,865,852 | B2 | 3/2005 | Gower | |
| 7,201,348 | B1 | 4/2007 | Flammer | |
| 2002/0152881 | A1 | 10/2002 | Stevens et al. | |
| 2004/0050014 | A1 | 3/2004 | Lisa et al. | |
| 2004/0108950 | A1 | 6/2004 | Zaar | |
| 2007/0261542 | A1 | 11/2007 | Chang et al. | |

FOREIGN PATENT DOCUMENTS

| | | |
|---|---|---|
| EP | 1752730 A2 | 2/2007 |
| FR | 2757937 A1 | 7/1998 |
| FR | 2789484 A1 | 8/2000 |

(Continued)

OTHER PUBLICATIONS

H. E. Dickard, Mini-RPV Recovery System Conceptual Study, Aug. 1977, pp. 193-194, Figure 73.*

(Continued)

*Primary Examiner* — Timothy D Collins
*Assistant Examiner* — Nicholas McFall
(74) *Attorney, Agent, or Firm* — Osha • Liang LLP; John W. Montgomery

(57) ABSTRACT

In this invention, there is provided a method and device for shielding and deflecting unguided missiles, mortars and other projectiles and ordnance. A plurality of lighter-than-air balloons are tethered from a plurality of ground anchors so that the balloons are positioned spaced apart, adjacent to, along and buoyed above the border to be defended between the launch area and the target area. A defense shield is suspended from the plurality of tethered lighter-than-air balloons, extending generally vertically covering a range of heights for engaging and deflecting missiles launched along the expected trajectories.

24 Claims, 8 Drawing Sheets

FOREIGN PATENT DOCUMENTS

| | | | |
|---|---|---|---|
| GB | 2001417 | | 1/1979 |
| GB | 121148 | | 12/1983 |
| JP | 2005-090932 | A | 4/2005 |
| KR | 10-2008-0068055 | A | 7/2008 |
| WO | 2004054667 | | 7/2004 |

OTHER PUBLICATIONS

PCT International Preliminary Report on Patentability with Written Opinion dated Jul. 14, 2011 in related PCT/US2009/069103, Berman et al. (8 pages).
PCT International Search Report dated Oct. 26, 2010 in related PCT/US2009/069103, Berman et al. (10 pages).
Tethered Aerostat Radar System fact sheets; Air Force Link; 2 pages; Sep. 6, 2008.
The Most Popular, Most Advanced, State-of-the-Art Airship Available; Worldwide Aeros Corp.; 1 page; no date.
The Aeros 40D Sky Dragon Airship Training, Support and Specifications; Worldwide Aeros Corp.; 1 page; no date.
Easily Transportable and Rapid Deployable Aeros 1170 Tethered Aerostat System; Worldwide Aeros Corp.; 1 page; no date.
TCOM Innovations in Aerostat Technology; TCOM; Sep. 6, 2008; 1 page.
What is an Aerostat?; TCOM; Sep. 6, 2008; 1 page.
What is a Mooring System?; TCOM; Sep. 6, 2008; 1 page.
What is a Tether?; TCOM; Sep. 6, 2008; 1 page.
What Types of Payloads Can Be Used?; TCOM; Sep. 6, 2008; 1 page.
Cut Resistant Gloves and Other Applications & General Properties of Vectran Fiber; VECTRAN; Sep. 6, 2008; 3 pages.
Tensile Properties; Finishing Options; Impact Resistance; VECTRAN; 2 pages; no date.
Nylon Netting Material 44mm; www.ahh.biz; Sep. 6, 2008; 2 pages.

* cited by examiner

UNGUIDED MISSILE AND PROJECTILE DEFENSE SHIELD SUPPORTED BY TETHERED BALLOONS

RELATED APPLICATION

The present application claims priority to U.S. Provisional application Ser. No. 61/141,868, titled UNGUIDED MISSILE AND PROJECTILE DEFENSE SHIELD SUPPORTED BY TETHERED BALLOONS, by inventor Joel F. Berman, filed Dec. 31, 2008, which is incorporated by reference herein and relied upon for priority and all legitimate purposes.

BACKGROUND OF INVENTION

1. Field of the Invention

This invention relates generally to devices and methods for shielding and deflecting missiles, mortars, and other projectiles launched from a ground launch location across a border toward a ground target location.

2. Background Art

Helium is much lighter-than-air. The difference is not as great as it is between water and air (a liter of water weighs about 1,000 grams, while a liter of air weighs about 1 gram), but it is significant. Helium weighs 0.1785 grams per liter. Nitrogen weighs 1.2506 grams per liter, and since nitrogen makes up about 80 percent of the air we breathe, 1.25 grams is a good approximation for the weight of a liter of air. There are about 28.2 liters in each one cubic foot. Thus, the lift of one cubic foot of helium in the air is about 28.2 grams.

One can determine the lifting capacity of the helium based upon the volume of the balloon. Assuming a lighter than air device (generally referred to herein as a "balloon") is spherical, the volume may be determined from the radius of the balloon. The volume of a sphere is $4/3 \cdot \pi \cdot r^3$, where r is the radius of the balloon. The radius of the sphere is half the diameter. Cube the radius (multiply it by itself twice: $r^3 = r \cdot r \cdot r$), multiply by $\pi$ (approximately 3.14) and then multiply by 4/3. By measuring the balloon, in feet, the volume of the balloon is calculated in cubic feet. One cubic foot of helium will lift about 28.2 grams, so multiplying the volume of the balloon by 28.2 will give the lift force. Divide by 448—the number of grams in a pound—to determine the number of pounds it can lift.

Consider, for example, a 20-foot balloon has a radius of 10 feet. The calculation of the volume is 10 ft·10 ft·10 ft·3.14·4/3=4,186 cubic feet of volume. The calculation of lifting force (or buoyancy) is 4,186 cubic feet×28.2 grams/cubic feet=118,064 grams. This is converted into pounds of lifting force as 118,064 grams/448 grams per pound=263 pounds of lifting force. In another example, a 100-foot-diameter balloon can lift about 33,000 pounds! A 100 foot diameter balloon has a radius of 50 feet. 50·50·50·3.14·4/3=523,333.34 cubic feet of volume. 523,333.34 cubic feet×28.2 grams/cubic foot=14,758,000 grams/448 grams per pound=32,942 pounds of lifting force. Other lighter-than-air balloons, aerostats, and airships may come in different shapes for which the volume may be calculated or measured to provide the desired amount of lifting force. Unless otherwise indicated by the context, or unless otherwise specifically indicated, the term "balloon" may be used in this application to refer to any type of lighter-than-air devices whether gas filled balloons, hot air balloons, weather balloons, aerostats, blimps, dirigibles, or other lighter-than-air airships.

SUMMARY OF INVENTION

According to one or more embodiments, the inventor has discovered a novel device and a method for defending against ground launched unguided missiles, rockets, mortars, projectiles, and other flying ordnance (that may be generally referred to herein as "missiles"), by blocking, shielding, intercepting and/or deflecting such missiles, from an intended target area by providing a defense shield system and method that includes suspending a shielding screen supported vertically in the air by balloons positioned generally along and above a border or perimeter boundary interposed between a launch sight and a target sight on either side of the border or perimeter boundary.

According to one or more embodiments, of the present invention, there is provided a defense shield system comprising a shielding screen supported in the air by balloons that are positioned and tethered in position along and above a border, or along and above an area perimeter, to intercept and deflect missiles, mortars, projectiles or other flying ordnance that may be launched across the border or perimeter.

According to one or more embodiments, the balloons may be positioned at the top of the shielding screen. According to one or more alternative embodiments the supporting balloons need not be at the top of the shielding screen. They may be significantly higher than the top of the shielding screen to reduce the opportunity to be shot down. They could be a mile or higher than the top of the blocking material to avoid being shot down and/or to make them less able to be targeted.

According to one or more embodiments, self sealing materials can be used for the "skin" of these balloons in case of puncture and to make them more durable.

According to one or more embodiments, an air supported defense shield system comprises a lightweight shielding screen formed of a material such that may be made of Nylon®, Kevlar®, Vectran®, or another high strength, lightweight polymer fibers or carbon fibers or compound carbon and polymer filament. In one or more embodiments high strength polypropylene netting might be used to form the shielding screens as a relatively low costs alternative. The material of the shielding screen may be formed of strands, fibers, stings, ropes or wires made of lightweight, high-strength material. Such strands may be interwoven into a mesh, a net material, or a fabric. According to one embodiment, the material forming the shielding screen comprises a mesh or netting that has interwoven lightweight, high strength strands. The strands may be spaced sufficiently far apart to permit transfer of wind through open spaces between the strands so that there is a small amount of wind resistance. The strands are woven together sufficiently closely spaced to intercept or engage missiles, mortars, and other projectile, and air born ordnance (all of which may be referred to herein as "missiles"). The resulting net material of the shielding screen is sufficiently strong to intercept and engage the missiles with an amount of resistive force as they travel through the air along a path or trajectory from a launch area toward a target area such that the path is changed by the resistive force applied by the shielding screen.

According to one or more embodiments, the net material of the shielding screen has sufficient impact strength to withstand impact and avoid immediate penetration of missiles. According to one or more embodiments, the net material is sufficiently flexible to "give" (i.e., to flex and/or deform) with the impact and to engage the flying missile and to progressively apply resistance or drag force to the flying missiles so that the trajectory is changed and the missile is deflected.

According to one or more embodiments, the net material may eventually give way and the projectile may pass to the other side of it, but the material significantly alters and/or slows down the trajectory of the missile. As well, according to one or more embodiments, the net material can be placed in "layers", that is one in back of the other, for missiles that penetrate the first, another layer of shielding material is behind it. Also, in case a first shielding screen is knocked down, a second shielding screen may remain in place to intercept missiles.

According to one or more embodiments, of the present invention, there is provided a defense shield including at least one shielding screen supported in the air by tethered balloons, aerostats, airships or other lighter-than-air devices that are buoyant in air, and positioned adjacent to, along and above a border, or adjacent to, along and above an area perimeter, to intercept and deflect missiles, mortars projectile or other ordnance. According to one embodiment, the balloons may be tethered by tether cords that comprise a high strength-to-weight material such as Nylon®, Kevlar®, Vectran®, carbon fiber, composites, or combinations of such materials. In one or more embodiments high strength polypropylene cord or rope might be used to tether the balloons and/or the shielding screens as a relatively low costs alternative.

According to one or more embodiments a supported shielding screen includes a plurality of independently supported 'panels' such as net screens that may be aligned in a row independent of each other, side by side or overlapping one another along the edges.

According to one or more embodiments, a plurality panels, such as net screens, form a shielding screen jointly supported by one or more shared balloons. The panels may be aligned in a row side by side, or alternatively may be positioned overlapping along vertical edges of the panels.

According to one or more embodiments of the present invention, there is provided a lighter-than-air, buoyant apparatus ("balloon"). The buoyancy of the balloon is provided by holding lighter-than-air gas, such as helium. The buoyancy may be controlled and may be maintained or adjusted depending upon atmospheric conditions, by supplying controlled amounts of replacement light gases. The buoyant gas may for example comprise helium for its stability. In one or more embodiments, the balloon may be controlled by supplying replacement gas through a conduit from a supply on the ground. In an alternative embodiment, controls may be automated, as by use of an altimeter controlled valve, or may be remotely controlled, as by a communication line or radio controlled valve operated from a remote control transmitter. The controls allow the balloon to be refilled with lighter-than-air, buoyant gas through a conduit from a supply such as a helium gas storage tank on the ground. The supplying of lighter-than-air gas is controlled for maintaining support for a shielding screen over an extended period of time or substantially continuously as long as the apparatus is maintained and refilled.

According to one or more embodiments of the present invention, the balloon may comprise a hot air balloon and a controlled hot air burner may be carried by the hot air balloon. In one or more embodiments, the burner is controlled to maintain the balloon aloft. In one embodiment, the controls are automatic based upon altitude sensors. In one or more embodiments, the burner may be controlled remotely, such as from the ground via communication line or via radio control signals. In one alternative embodiment, there may be a refillable supply of fuel for the burner carried onboard by the balloon. In one alternative embodiment, a fuel supply for the burner may be provided or refueled through a fuel conduit from a fuel supply on the ground. Thus, the burner can be operated for maintaining hot air in the balloon to support a shielding screen during an extended period of time or substantially continuously as long as the burner and balloon are re-fueled and maintained operational.

One skilled in the art will recognize workable embodiments of the apparatus may include, but are not limited to, balloons, aerostats, airships, and other lighter-than-air devices that are buoyant in air (balloons). The buoyancy that is provided by holding lighter-than-air gas, such as helium or heated air and combustion gas may be maintained or adjusted depending upon atmospheric conditions, by supplying controlled amounts of replacement light gases, or by controlling a hot air burner and supplying replacement fuel for the hot air burner, and any combination thereof. Thus, controls may be automated, as by use of an altimeter controlled valve or burner, or may be remotely controlled, as by a radio controlled valve or burner operated from a remote transmitter.

Other aspects and advantages of the invention will be apparent from the following description and the appended claims.

DETAILED DESCRIPTION

It is common in war and border conflicts between nations for missiles, rockets, mortars, and other projectiles (for purposes of clarity, any of these types of ordnance may be referred to herein as "missiles") to be launched, fired, or lobbed from one area over the border toward a target area. For example, the northern border of Gaza is in some places no more than about ten miles wide and in many instances, such as at a military compound, a border area may be less than a mile wide. Currently missiles of various types are being launched from northern Gaza over a border, an agreed armistice line, into towns in the neighboring country of Israel.

Figure 1:
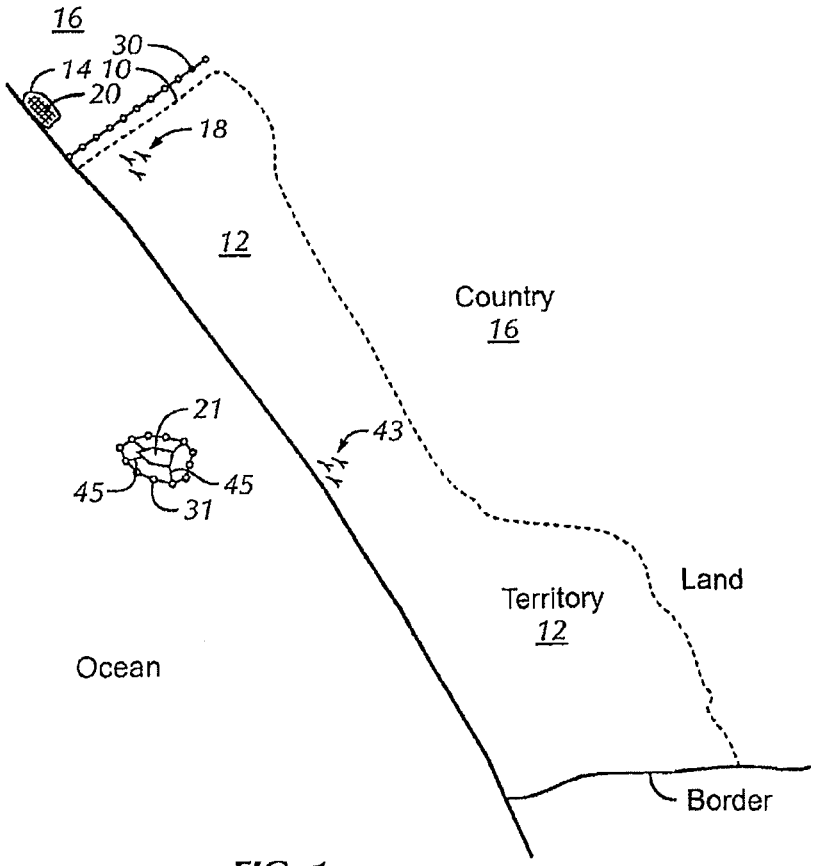
FIG. 1 is a schematic top view representation of a lighter-than-air defense shield along a border between a missile or projectile launch area and a target area and an alternative, a lighter-than-air defense shield around a ship between an exterior projectile launch area and a shipboard target area.

For example, in FIG. 1, a border 10 exists between one territory 12 and a town 14 in an adjacent country 16. In the event that warring factions or terrorist groups have missile launching capabilities from a launch area 18 across the border 10, they could fire missiles aimed at a target area 20 that might be located within the town 14. Innocent people in the town 14 can be injured and killed by such missiles if they are permitted to travel along the trajectory of the intended path. According to one embodiment of the invention, to reduce the risk of such missiles reaching the target area 20 and the surrounding town 14, a missile defense shield 30 may be installed along the border 10 between the target area 20 and the launch area 18.

Cross border launched missile attacks have been going on for some time. Often such attacks are made without well directed missiles, rockets, or mortars. It is not uncommon for many missiles launched across borders to be unguided rockets, mortars, "home-made" ordnance, or low-tech explosive projectiles. Many of these rockets and mortars are simply propelled and not "guided". These are not guided missiles that can be routed or controlled during flight to the target. In such cases, the missile may be aimed at a target and fired to travel along a trajectory without further control or guidance (unguided missiles). Such missiles are typically aimed to travel along an arc trajectory toward a target, but once they are aimed and launched they are not guided. Short range and long range rockets may be built or acquired and fired from a launch area in one country to a target area in another country. Too often the targets include cities, towns, and villages inhabited by innocent civilians, non-combatant men, women, and children and indiscriminately injure, maim, and kill innocent victims.

Sometimes missiles, rockets and mortars are launched from outside a military compound by opposing forces targeting military targets. Civilians and troops are being injured and killed because of these relatively crude devices that are often fired from civilian populated areas (making it harder to strike back, for wariness of collateral damage).

In one alternative embodiment, also shown in FIG. 1, the target area might be a ship 21. To defend against projectiles fired from a seaside (or ship-based) launch area 43, a sea defense shield 31 might be supported by balloons and moved along with ship 21 by ship supports or ship tethers 45.

Figure 2:
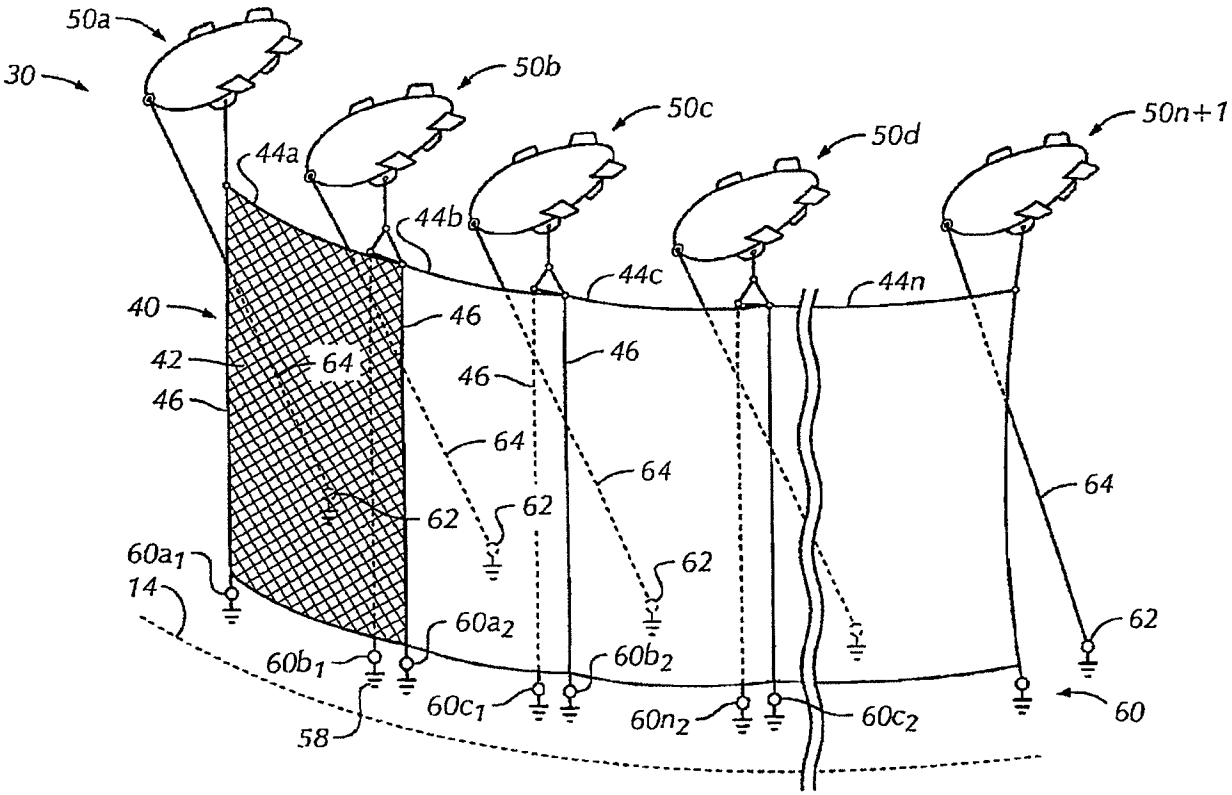
FIG. 2 is a partial perspective view of one embodiment of a lighter-than-air balloon (for example, a gas-filled aerostat) supported defense shield.

According to one embodiment as may be seen in FIG. 2, a solution to a missile defense shield is provided that is simpler than many modern defense systems such as computerized radar tracking systems, surface-to-air intercepting missiles, air-to-air intercepting missiles, laser intercept systems, and satellite based intercept systems being developed to be effective against modern guided missiles. The present invention could be installed quickly for defending against relatively low technology missiles and projectiles. According to one or more embodiments of the present invention, there is provided a missile defense shield 30 that may comprise a shielding screen 40 that may comprise a net sheet 44 or a plurality of netting sheets 44(*a*), 44(*b*), 44(*c*), . . . , 44(*n*) supported in the air tethered by a lighter-than-air balloon 50, or a plurality of lighter-than-air balloons 50(*a*), 50(*b*), 50(*c*), . . . , 50(*n*+1). In one embodiment, there will be a pair of balloons 50(*a*), 50(*b*) supporting each net sheet 44(*a*), balloons 50(*b*) & 50(*c*), supporting net sheet 44(*b*), balloons 50(*c*) & 50(*d*), supporting net sheet 44(*c*), balloons 50(*n*) (not shown) & 50(*n*+1), supporting net sheet 44(*n*). The lighter-than-air balloons 50, may for example comprise aerostats 50(*a*), 50(*b*), 50(*c*), . . . , 50(*n*+1), as depicted in FIG. 2.

It will be understood by those skilled in the art that although the drawings depict the balloons 50 as air ships in FIG. 2 (and depict the balloons as traditional balloons in FIGS. 3, 4, 5, 6, and 7 below), balloons, airships, or other lighter-than-air devices 50 (all of which may be referred to herein for convenience as "balloons" 50) may be employed according to one or more embodiments of the invention. The balloons 50 are sufficiently buoyant in air and/or sufficiently numerous to support a plurality of net sheets 44(*a*)-44(*n*) positioned generally along and above a border 10 to intercept and deflect missiles, mortars, projectile or other unguided flying ordnance. Thus, as a defense against missiles that are merely aimed and fired with an arching trajectory over a border 10, the proposed defense shield 30 does not require a sophisticated system for detecting and tracking randomly fired missiles and then launching interception counter-missiles or laser beams. Instead, the defense shield system 30 provides a plurality of net sheets 44 forming a shielding screen 40 extending along the border 10, all supported by balloons and maintained aloft substantially continuously during an extended period of time and held in place by tethering the balloons from one or more ground anchors 60. The net sheets 44 may be overlapped along the vertical edges to facilitate maintaining substantially continuous shielding screen 40 even when there is some relative movement between the individual net sheets 44. Due to the relative simplicity (i.e. a lack of complexity), in many cases, the inventive defense shield 30 may be relatively more reliable and less likely to fail than more sophisticated defense systems such as those designed for missile detection, tracking, and counter-firing of intercept missiles.

According to one or more embodiments, the supporting balloons need not be positioned immediately at the top of the shielding screen. The balloons may be positioned significantly higher than the top of the shielding screen to reduce the opportunity to be impacted by the missiles the shielding screen is designed to intercept and also avoid or reduce the opportunity for the balloons to be shot down by those intending to launch the missiles. For example, the balloons could be a mile or more higher than the top of the shielding screen material to avoid being shot down and/or to make them less able to be targeted.

According to one or more embodiments, the balloons may be self-sealing to reduce the adverse affects of any punctures and to further reduce the opportunity to be shot down. For example, a self sealing material can be used for the "skin" of the balloons to seal and reduce the escape of lighter-than-air gas in case of puncture and to make them more durable.

According to one embodiment, a missile need not be completely blocked or immediately stopped at the shielding screen 40 in order for the defense shield 30 to be effective. Rather, by intercepting and imparting drag force on the missile along its trajectory, the missile is deflected by changing its velocity and direction so that it will miss the intended target area 20 and closely surrounding areas such as town 14.

According to one or more embodiments a supported shielding screen include a plurality of independently supported 'panels', such as net screens, that may be aligned in a row independent of each other, side by side or overlapping one another along vertical edges.

According to one or more embodiments a plurality of panels, such as net screens, form a shielding screen jointly supported by one or more shared balloons. The panels may be aligned in a row, or alternatively may be positioned overlapping along vertical edges of the panels. For example, if one needs to 'cover' a space 10,000 yards wide, one could line up 200 panels or net screens each 50 yards wide, all independently supported by balloons so that they are independently tethered and secured. As well, as noted above, one could set these panels or net screens up more than one 'layer' deep, namely, one behind another in a direction of expected missile travel from a launch site to a target area.

The defense shield 30 may comprise a generally continuous shielding screen 40 that may be made of a net material 42 that is strong and flexible so that it easily deforms upon impact by a missile and then drags against the motion of the missile and thereby deflects the missile from the trajectory toward the target area. For example, free-flying artillery rockets lacking any guidance system may be launched across a border, such as the Kassam type Hamas-made rockets known to have been fired across the border between the Gaza Strip and Israel. For another example, Katyusha Russian made rockets are known to have been fired across the border from southern Lebanon into Israel. For comparison, a bullet-proof vest must completely stop a projectile for it to be effective because a human being is directly on the other side. In the case of missiles such as rockets, mortars and other projectile ordnance, the targeted human beings are at a target area 20 a substantial distance from the shielding screen 40 and not within inches of the shielding screen 40. The target area 20 is a distance away so that minor deviations in the trajectory will be multiplied by the distance traveled to increase the total deflection and thereby miss the target area and closely surrounding areas. For example with reference to FIG. 4, a netting formed using lightweight and yet strong fiber suspended high in the air, and in particular, at an elevated position, that might generally correspond to the top 24 of an expected arching trajectory 22, can interrupt the terminal portion of the trajectory 26 sufficiently to cause the rocket to follow a different trajectory 28 and completely miss the intended target area 20 and surrounding human habitation areas.

According to one embodiment, a shielding screen 40 comprises a plurality of net sheets 44(*a*), 44(*b*), 44(*c*), . . . , 44(*n*), where "n" represents any number of net sheets 44 that may be made of a strong wind permeable net material 42. Each net sheet 44 is spaced along the border 10 and may overlap a short distance at each juncture 48 to form a shielding screen 40 extending generally continuously along the border 10. Each net sheet 44(*a*), 44(*b*), 44(*c*), . . . , 44(*n*) may be held by one or more balloons 50(*a*), 50(*b*), 50(*c*), 50(*d*), . . . , 50(*n*), 50(*n*+1). In one or more embodiments, each net sheet 44 is held by attachment to two balloons, one at either side of each net sheet. In alternative embodiments (not shown in the drawings), more than one net sheet 44 might be held by a single balloon, or each net sheet 44 might be attached to a greater number of balloons. A substantially continuous shielding screen 40 is formed elevated in the air extending a desired distance along the border 10 to be protected by the defense shield system 30.

According to one embodiment, the balloons 50(*a*)-50(*n*+1) are anchored through the tether cords 46 that extend from main ground anchors 60 located on the ground 58 at or below each balloon 50(*a*)-50(*n*+1) and spaced along and adjacent to the border 10. The tether cords 46 may extend generally vertically up from the ground anchors and along the side edges of the net sheets 44. According to one or more embodiments, where there is an overlap of the side edges of the net sheets and each net sheet 44(*a*)-44(*n*) may be provided with pairs of anchors 60(*a*1) & 60(*a*2), 60(*b*1) & 60(*b*2), and . . . 60(*n*1) & 60(*n*2) so that the overlapping portions of the net sheets 44 are held in an overlapping relationship to form a substantially continuous shielding screen 40. To facilitate holding the net sheets 44 in position, the balloons 50 may also be tethered with angled tether cords 64 attached to offset anchors 62. In one alternative embodiment, the angled tether cords 64 may be attached directly to the balloons 50 as shown in FIG. 2. In alternative embodiments, the angled tether cords 64 may be attached to the main tether cords 46 or to the net sheets 44 such that holding the net sheets in place will also hold the attached balloons in place.

A balloon filled with lighter-than-air gas or with hot air can lift and carry as much as several thousand pounds, or more, depending upon the volume of gas or heated air in the balloon and the temperature differential between the balloon air and ambient air. For example, helium filled balloons, aerostats and airships can have significant buoyancy up to tens of thousands of pounds, depending upon the volume of helium. Thus, according to one or more embodiments a plurality of balloons, aerostats, airships, or other lighter-than-air devices 50, having requisite buoyancy and spaced as closely together as may be needed, are secured to net sheets 44 to form and support a shielding screen 40 at an appropriate altitude for missile and projectile interception. The size, number and spacing of the net sheets 44 between balloons 50 will depend upon the weight of the net material 42. Balloons tethered high above the expected missile or projectile trajectory would be very difficult to shoot down. For example, at altitudes of one, two, three, or more miles above the ground 58, the speed of bullets fired from the ground will slow by the force of gravity and upon reaching a maximum altitude the speed will not be great and thus the kinetic force of a bullet will be small. In one theoretical example, a net sheet 44 that has a given horizontal width, might weigh about one pound for each twenty feet of vertical length. In this example, a balloon having a buoyancy of about 530 pounds lift force could support a total vertical length of two miles of such a lightweight net sheet 44. For another theoretical example, a net sheet 44 made of heavier netting material might weigh one pound for each five feet of length. Such a netting material might for example, be made of a stronger mesh material, a wider sheet, or a net sheet made of multiple layers of mesh material. Two miles of such a net sheet made of such a stronger wider material in this example, might weigh about 2100 pounds so that it could be supported by a balloon having a buoyancy of more than about 2100 pounds lift force. It will be understood that two miles is merely an example and other heights might be appropriate in a given situation. In cases where the height might need to be more than two miles high, for example three, four or more miles, lighter materials, or additional lift force might be provided. An extra amount of lift force may be provided by increasing the buoyancy of the balloon and the additional lift force will be held by the tether cord 46 anchored to the ground. It will be understood that in general for most materials, stronger net sheets are likely to weigh more than weaker nets made of the same types of fibers or woven strands. Thus, bigger balloons or a greater number of balloons will be required for carrying the heavier load. It will be understood based upon this disclosure that there will be a balance between the net weight and strength and the size and number of balloons to provide the total buoyancy that will be required. Based upon this disclosure, it will further be understood that the additional lift force will desirably be equal to or greater than the wind resistance force that might be expected to act upon the balloon and the net sheet so that total upward force will keep the balloon and the net sheet aloft even when acted upon by any expected wind.

The height or the range of heights of an expected trajectory 22, 26 of missiles launched from a particular ground launch area 18 toward a particular ground target area 20 can be determined, for example, by physics formulas and calculations or by actual testing. For the expected speed or amount of propulsion for a given type of rocket, mortar, projectile, or other missile there will be a range of heights at the border for trajectories that would allow such missiles to reach the target area or to reach the surrounding town or populated areas around the intended target area. The maximum speed or amount of propulsion of a particular missile will limit its maximum altitude 24. A missile traveling along a trajectory with a relatively low maximum altitude is close to the ground and requires a higher speed in order to reach a long distance target before gravity pulls the missile to the ground at a point short of the target area. In order to intercept a missile or projectile along a trajectory 22, 26 that will actually reach the target area 20, the defense shield 30 may be suspended so that it vertically spans the expected trajectory height range that would otherwise allow such missiles to reach the target area. In one or more embodiments, the net sheets 44 would not necessarily need to start at the ground and may instead start at a significant height above the ground. Thus, according to one or more embodiments, the projectile deflecting net sheets 44 would not need to extend the entire height distance from the ground 58 to the balloons 50. A shorter net sheet may be adequate to cover the appropriate trajectory range. While the balloons would support the net sheets 44 at or above the maximum height 24 of the expected trajectory height range, the net sheets 44 could hang down to an altitude below the expected minimum trajectory height range. A lightweight tether cord 46 might extend from the main ground anchor 60 to the maximum altitude and the net sheets 44 may extend a much shorter distance so that the total weight of netting material 42 in the net sheet 44 might be less than a similar strength net sheet extending all the way from the ground 58 to the maximum altitude of the balloons 50. In one theoretical example, a maximum altitude of the expected trajectory range might be about two miles and the minimum trajectory to reach the protected target area might be about ½ mile above the ground. Thus, in this theoretical example, the total height of the net sheets 44 could be about 1½ miles extending from at or above about two miles down to a height at or below ½ mile above the ground level. Those skilled in the art upon reading this disclosure may consider other example heights and length of net sheets to cover possible expected maximum and minimum missile trajectories. In one or more embodiments, the tether cord 46 could extend along the height of the shorter net and extension tether cords could extend from the bottom of the net sheets or from the bottom ends of the tether cords 46 down to the main ground anchors 60. Thus, shorter and stronger net sheets 44 might be used in appropriate situations where the target area 20 is sufficiently distant from the launch area 18 and a low trajectory missile would not have sufficient velocity to reach the target area 20.

Figure 3:
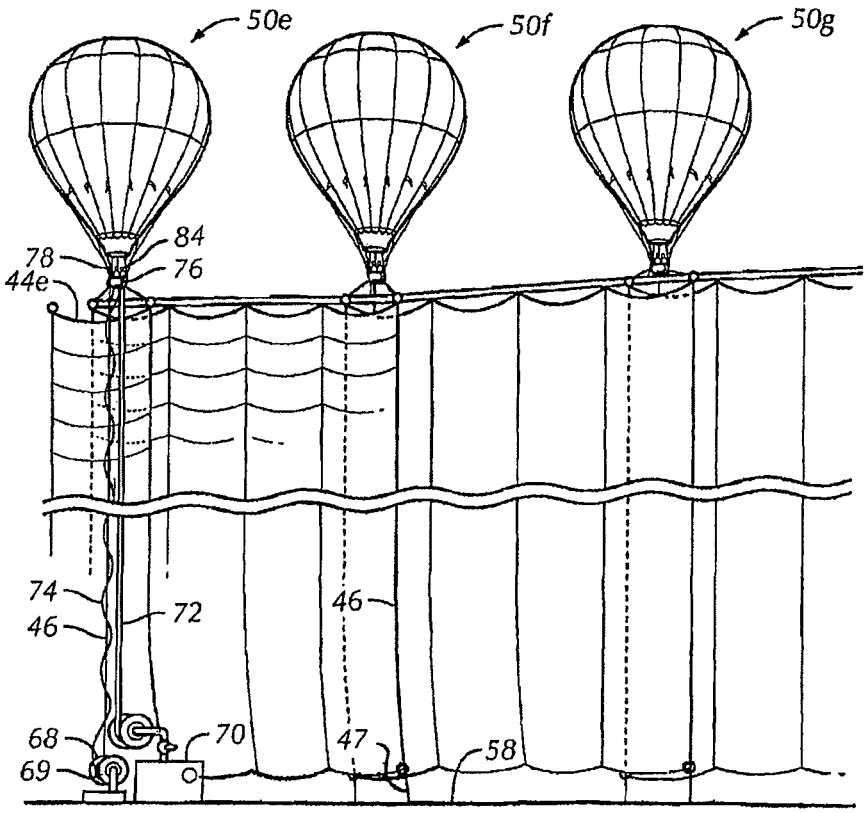
FIG. 3 is a partial perspective view of one embodiment of a lighter-than-air balloon (for example, a gas filled balloon or a hot air filled balloon) supported defense shield.
Figure 4:
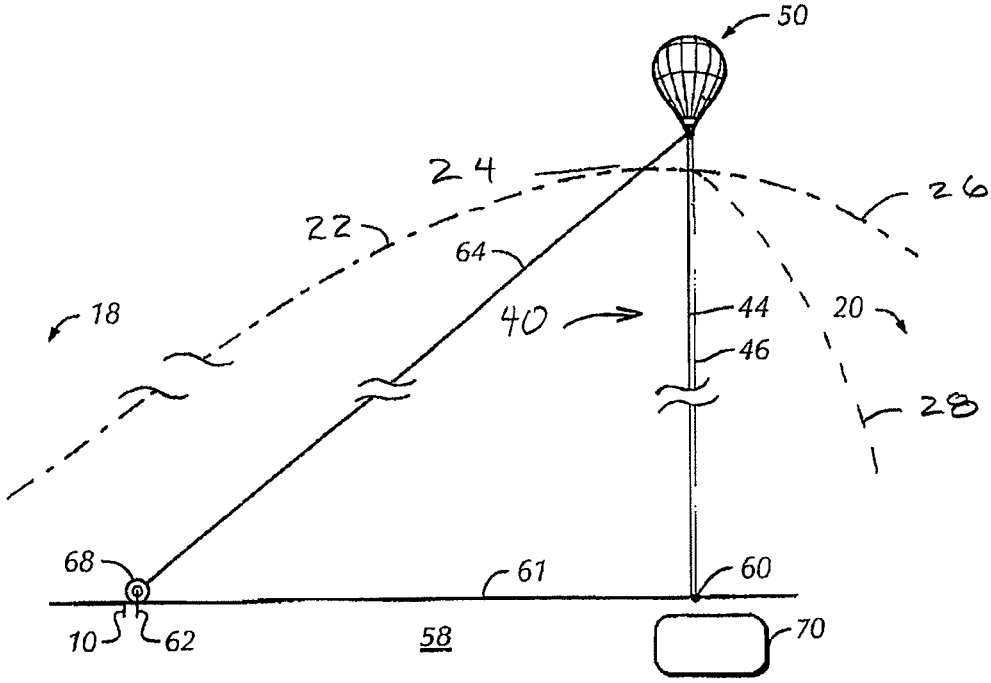
FIG. 4 is a side view of an embodiment showing anchoring and tethering of a defense shield.

According to one or more embodiments, the plurality of balloons, as schematically depicted in either FIG. 2 or in FIG. 4, may be anchored to anchors 60 at the ground 58 directly through the net sheets 44 or through tether cord 46 extending along the net sheets 44 from the balloons to the ground 58. In instances as schematically depicted in FIG. 3 where the net sheets 44 do not reach to the ground 58, an extension tether cord 47 might be used. The tether cords 46 (or the extension tether cords 47) might be secured to one or more reels 68 that allow the tether cord 46 to be rolled in or out. Also, in one or more embodiments, so that wind resistance and missile impact force can be counter-balanced with consistent tension applied to the tether cord 46, a biasing device 69 may be attached to or included in the reel 68. The tether cord 46, net sheet 44, and, if required, the extension tether cord 47 may be made of a high strength to weight material such as one or more of Nylon®, Kevlar®, Vectran®, or carbon fiber. In one or more embodiments, the net material 42 or tether cords 46 or extension tether cords 47 may be comprised of a low stretch material such as Vectran® that can also support a metallic communication line 74 for providing control information to operate the buoyancy controls 76 of the balloon, whether for operating a burner 78 for a hot air balloon or a lighter-than-air gas control valve 84.

According to one or more embodiments as in FIG. 3, the pluralities of balloons are spaced in linear succession along and above a border to support the netting above and along the border. According to one embodiment, the netting is supported above and along a line that is adjacent to and spaced back from the border toward the defended target area. Each balloon may be anchored to an offset anchor 62 and may also be tethered by an angled tether line 64 against drifting or movement away from the desired shielding position above the main ground anchor 60. In one embodiment, the angled tether line 64 is connected to the offset anchor 62 through a biasing device for providing a predetermined amount of tension to the angled tether line 64. For example, such a biasing device might include a reel, such as reel 68, which is rotationally biased toward the offset anchor 62. In one embodiment, the offset anchor 62 may be spaced an offset distance 61 from the main ground anchor 60 toward the border 10 and toward the missile launch area 18. In that embodiment, the amount of tension may be predetermined so that the impact of a missile is accommodated with give, and then the net sheet is returned to its shielding position. The angled tether line 64 may be made of a high strength-to-weight material such as Nylon®, Kevlar®, Vectran®, or carbon fiber. In one or more embodiments, the angled tether line 64 may be comprised of a low stretch material such as Vectran® that also supports a metallic communication line 74 for providing control information to operate the buoyancy controls 76 of the balloon, whether for operating the burner 78 for a hot air balloon or for controlling intake of discharge of lighter-than-air gas.

According to one or more embodiments as in FIG. 4, the net sheets 44 may be secured against drift. For example, a plurality of angled tether lines 64 that may be secured to the ground 58 at an offset distance 61 in either or both directions from the main tether cord anchors 60. The offset should be in the direction opposite from the expected movement to be prevented. The angled tether lines 64 may be biased with a predetermined amount of force to be applied to the net sheets to offset the movement force. For example, the angled tether line may be retractably coiled in a dispensing anchor device like reel 68 shown in FIG. 3. Such a reel 68 may also include a biasing device 69 that may be designed to "give", or reel-out or "loose" at a controlled rate. In one embodiment, the coiled retraction may be provided with a spring-loaded coil-operated spool, as for example like a retractable coiled metal tape measure.

In one or more embodiments, the angled tether line 64 is connected to the offset anchor 62 through a biasing device for providing a predetermined amount of tension to the angled tether line 64. For example, such a biasing device might include a reel, such as reel 68 as shown in FIGS. 3 and 4 and bias device 69, as shown in FIG. 3, which is rotationally biased toward the offset anchor 62. In one or more embodiments, the offset anchor 62 may be spaced an offset distance 61 from the main ground anchor 60 toward the border 10 and toward the missile launch area 18. In such an embodiment, the amount of tension may be predetermined so that the impact of a missile is accommodated with give, and then the net sheet is returned to its shielding position. Thus, the angled tether line 64 may be anchored at a position towards the launch area 18 with the net screen 44 position spaced a short distance back from the border 10 and towards the target area 20 to be shielded. This arrangement facilitates supporting the screen in the direction of impact by projectiles. The biasing as by coil tension is thus provided in the direction that the projectiles are coming from, so that when the projectile hits the material or net sheets, it gives at a certain calibrated rate to slow down the missile as the screen deforms and moves in the direction of the impact. The bias tension moves the net sheet back to a shielding position.

The angled tether lines 64 may be attached in front of each sheet towards the projectile launch areas. According to one embodiment, there may be two angled tether lines for each sheet, secured close to the top 144 of the netting material or about ¾ of the way up, whichever is more efficacious, that are secured as well towards where the projectiles are fired. As discussed previously, the angled tether lines 64 may play out at a certain rate or provide an amount of give, whether it is through a coiled spring system, or one or more mechanisms that control or calibrate the "give" to a desired rate to slow down, deflect, or stop the projectile given its expected speed, weight, force, configuration, etc.

Figure 5:
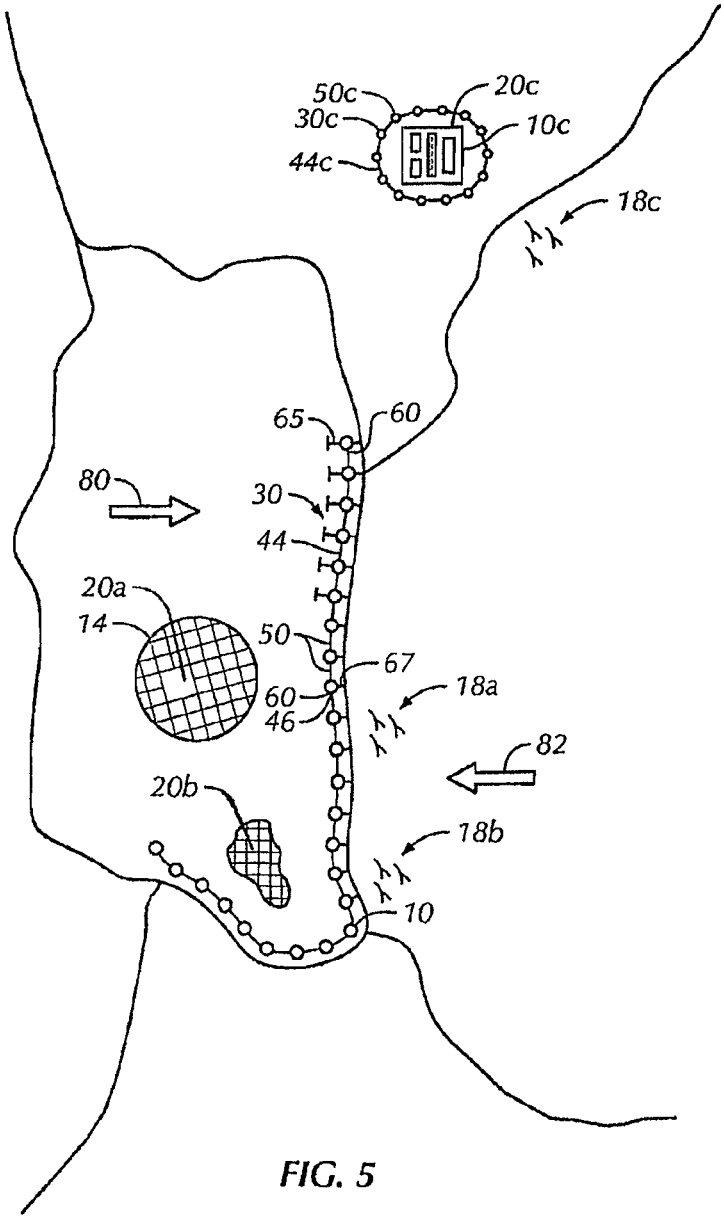
FIG. 5 is a schematic top view representation of an alternative lighter-than-air supported defense shield around a perimeter of a military camp between an exterior projectile launch area and an interior target area and according to another alternative lighter-than-air supported defense shield along borders between target areas and projectile launch areas.

In another embodiment, as shown in FIG. 5, when there are prevailing winds 80 in one direction or the other direction 82, the anchors for the angled tether lines 65 or 67 may be positioned up wind from the main anchor 60 or tether cords 46. In such situations, the force of friction from the prevailing winds 80 or 82 blows on the balloons 50 and the net sheets 44 of the defense shield 30 and provides a compressible horizontal force to counteract the impact of the missiles.

According to one embodiment also shown in FIG. 5, a defense shield 30(*c*) may surround the border 10(*c*) of a target area 20(*c*) that is a military base or other compound that is in an area that might be adjacent to a potential missile or projectile launch area 18(*c*).

Figure 6:
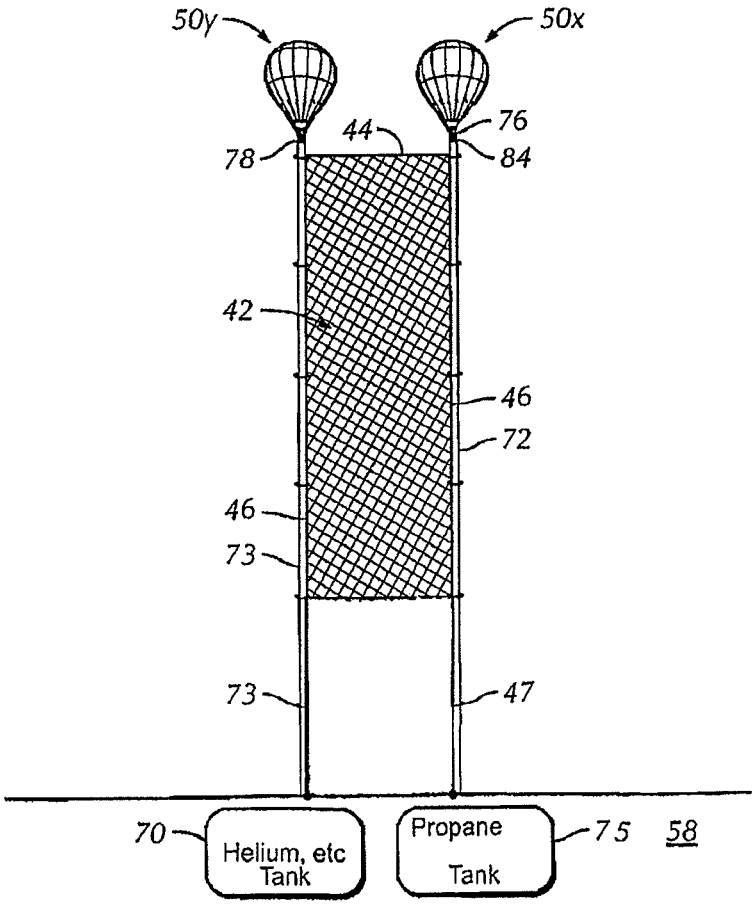
FIG. 6 is a front view of one embodiment of a single netting screen held at either side by balloons, including alternative systems for replenishing either lighter-than-air gas or fuel for a burner on board a hot air balloon.

As depicted in FIGS. 3 and 6, one or more sources 70 of lighter-than-air gas, such as helium, for buoyancy may be provided on the ground 58. Conduits 72 may be provided from the sources of gas to the balloons 50(*e*)-50(*g*) to keep the balloons up in the air at the desired altitude. Such gas sources 70 might, for example, comprise pressurized tanks 71 or other gas storage devices. For gas filled balloons 50*x* (in FIG. 6), the sources of lighter-than-air gas may be located at ground level, for example, in a secure facility on the ground or buried underground so that they do not become an easy target. The flow of gas to the balloon may be adjusted to "feed" gas through the conduits 72 at a determined set rate necessary for the balloons to continue to stay up. The flow of gas from the one or more sources 70 may also be variably adjusted to maintain the balloons at an appropriate altitude in variable temperature, wind, and other weather conditions. If helium gas is used, the helium may be supplied through the conduit 72 at a determined rate substantially equal to the expected "leakage" of gas from the balloons. Appropriate altitude monitoring devices 84, such as altimeters, may be carried on the balloons 50 for real time adjustment of gas or fuel to maintain a desired altitude.

In one or more embodiments, a tether cord 46 may support a separately attached transmission tube 73. In one or more alternative embodiments, an extension tether cord 47 may comprise a gas transmission tube 73 for conveying replacement fuel 75 from the ground 58 to a hot air balloon 50*y*. Thus, the transmission tube 73 may be integrally formed within the extension tether cord 47, as for example, the extension tether cord 47 may form a hollow transmission tube 73 or a woven extension tether cord 47 may enclose a coaxially disposed transmission tube 73.

In one or more embodiments, hot air balloons 50(*y*) may be used that have onboard burners 78. In one embodiment, an amount of fuel may be stored onboard for operating the onboard burner 78. Heat will dissipate from the hot air balloon 50(*y*) over time and onboard fuel may be burned in the onboard burner 78 to keep the balloon air sufficiently hot to maintain a proper altitude. The control of the burner 78 may be automatically programmed, for example by using an altitude monitoring device 84. Alternatively, the burner 78 might be controlled by remote control. The onboard fuel will be consumed and will run out after a period of time. To keep the hot air balloon aloft for longer periods of time, according to one embodiment, the fuel may be replenished from a fuel supply on the ground. The replenished fuel may be conveyed directly to the burner 78 or to the onboard balloon fuel storage through a lightweight conduit 72 that may be formed as part of a specialized extension tether cord 47 or the conduit 72 may be supported by attachment to a tether cord 46. Thus, according to one embodiment, the fuel, such as natural gas, propane, or other gaseous fuel for a hot air burner, may be kept in an appropriate storage tank on the ground below the balloon and may be "fed" through a tube at a calculated steady rate or periodically as necessary to control the buoyancy of the balloon and thereby keep the balloon and supported deflection shield system at the desired altitude. In one or more embodiments, the fuel storage may be a mobile storage tank, such as a tanker truck, and refueling can be accomplished on a schedule, sequentially along the border or as may be needed for individual balloons among the plurality of balloons to keep all the balloons substantially continuously aloft.

According to one embodiment, hot air balloons are used that do not have an onboard burner 78, and a burner may be provided on the ground below the balloons to heat the balloon air. After the balloon is launched and anchored in position, air may be heated at the ground level burner and sent up to the balloons through a conduit to keep the balloon aloft to the desired altitude. Appropriate altitude monitoring devices 84, such as altimeters, or balloon inflation of balloon lift monitoring devices, such as cord tension sensors, may be used in the balloons for real time determination of the altitude or proper inflation of each balloon where the altitude is determined by the length of the support cord. The differential temperature of internal air and external air might also be monitored to properly control lifting force where the altitude is not the only consideration.

According to one or more embodiments, the number and buoyancy of the balloons would be sufficient to provide an amount of lift force that is sufficient to overcome the downwardly directed force vector caused by the force of wind resistance against the net sheets and the balloons. In addition, according to one or more embodiments, a buoyancy "safety factor" of more buoyancy than the total required buoyancy for keeping the balloons and net sheets at the desired altitude may be provided by selecting a number and size of the plurality of balloons to provide extra buoyancy. For example, a safety factor of two or more times the amount of lift force required might be selected so that at least a double load could be supported by the lift of the balloons. The support for each portion of the netting according to one embodiment would be distributed to more than one of the balloons. Thus, even if one balloon deflates completely, the surrounding balloons will support the total weight of the defense shield at the location of the deflated balloon. The defense shield system would not fall and local sagging would be minimal. A replacement balloon could be inflated and elevated to take the place of the deflated or defective balloon without interrupting the effectiveness of the defense shield. In an alternative embodiment, as noted above, the net sheets may be layered one behind another as well as overlapping side over side so that if one falls, there is another one in position to intercept and/or block a missile at the same location.

According to one or more embodiments, the net sheets 44 are not intertwined or interlocked. According to this embodiment, if one net sheet falls or is knocked down it does not take the others down. The net sheets 44 may effectively overlap a sufficient distance so that relative movement along the edges does not open or interrupt the continuity of the defense shield. If one net sheet does go down, only that particular area becomes open and the whole area being protected by the remaining defense shield is not vulnerable. A replacement net screen can be elevated in place of the fallen net sheet and the integrity of the defense shield can be conveniently and rapidly restored.

Figure 7:
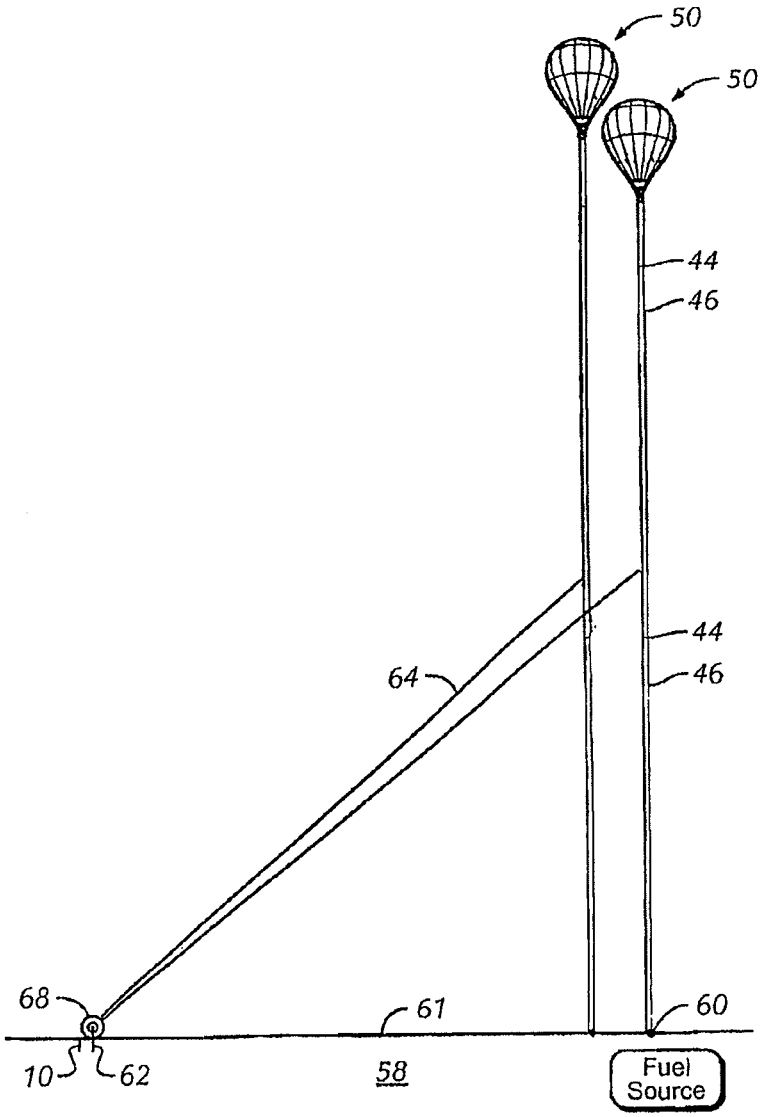
FIG. 7 is a schematic depiction of a missile or projectile moving along a trajectory from a launch area and deflected from the intended path toward a target area by a defense shield comprising a plurality of shielding screen sheets according to one or more alternative embodiments.

According to one or more embodiments, as shown in FIG. 7, the net sheets 44 may be arranged in overlapping sheets, arranged in vertical layers or "leaves" so as to preserve the integrity of the system. Thus, there might be more than one net sheet 44(*i*), 44(*ii*), etc. at every point along the border so that one net sheet 44(*i*) is spaced in back of the next net sheet 44(*ii*) so that if a missile penetrated or ripped through one net sheet it would be slowed by the first net sheet 44(*i*) and would impact another net sheet 44(*ii*) to slow the missile further and increase the effectiveness for changing the trajectory of the missiles and projectiles.

The net sheets 44 may be additionally layered so that there may be one or more additional net sheets 44(*iii*) (not shown) forming a shielding screen 40(*iii*) (not shown) in back of the first and second net sheets 44(*i*) and 44(*ii*), to provide additional deflection of missiles. In one or more embodiments, the added layers might be supported from separate balloons so that if one net sheet 44(*i*) goes down there may be a back up net sheet 44(*ii*) that will still defend against the missiles while the downed net sheet is replaced.

According to one embodiment, a defense shield system may be truck mounted or transported and deployable to a border or to a perimeter where rocket, missiles, mortars or other air launched ordnance may be a problem. For example, increased localized insurgent activity at a state border, city border, or a military base. A sea vessel could be used to deploy the inventive system on the sea, in front of or around warships. Variations might also be used at sea for moving vessels wherein the netting could be deployed in front of a ship, tethered to the ship or with its own propulsion assist system to move with the vessel and reduce or avoid slowing of the vessel. According to another embodiment, the system could run in sync with the boat's actual movement.

According to one or more embodiments, a defense shield may be quickly deployed if radar picks up a threat from a number of miles away. For one theoretical example such an embodiment may be a floating and guided defense shield, essentially as described above and also one that could be deployed over an "aggressors" territory or adjacent to it, as in international waters. In this embodiment, the military could guide the defense shield into place, and also move it around, using remote controlled propulsion devices at each end of the individual panels or net sheets, so as to intercept more advanced guided missiles, as near the Korean peninsula. If one generally knew the missile launching area from where the missiles were to be launched, one could guide a shield to be put in place near that area that could be in total a number of square miles wide that would have a significant chance of intercepting the missile before it entered the target area. This also could be deployed in a horizontal fashion (versus the vertical detailed hereto) with the balloons potentially well above the height of a defense shield that might be adjacent to or close to the ground. Such a defense shield could have the effect of an aggressor deciding not to launch, as such a launch might have the effect of the missile coming back down on top of the launch site or other site occupied by those launching the missiles. A possible use for this is that while current defenses against such missiles need to be very precise and generally involve another projectile intercepting the first, a defense shield according to one or more embodiments of the present invention would not have to be as precise.

According to one or more embodiments, the net material and the suspension system is designed to provide a calibrated amount of "give" from the fabric, netting, tethers, and/or anchoring systems to allow appropriate "capture" or sufficient change of velocity of projectiles to change the velocity and/or direction to deflect the missile away from the intended trajectory and target. According to one embodiment, the angled tether line 64 may be secured with a tensioning device such as a coiled loaded reel similar to a coiled spring loaded tape measure. In one embodiment, the tension may be adjustable according to the balloon lift, the weight of the net system, the altitude, the weight of the tether line already extended, and the wind and weather conditions. The "give" might also be adjusted according to the construction of the expected types of missiles (if known) at a particular location. This might be understood as similar to a bed sheet strung out tightly that might be torn and penetrated easier than a loosely strung bed sheet that will "capture" and absorb the impact without tearing. The loosely suspended netting system by easing its force slowly against the missile "catches" or partially catches the missile sufficiently to stop or deflect it from its intended target. Once again, in the case of a projectile without onboard propulsion, it is theorized that the closer the net is to a peak trajectory for a given missile, type, velocity, launch site and target sight, the slower the missile (the projectile will have reduced energy due to the action of gravity and wind resistance) and the more effective will be the netting to deflect the projectile. For any unguided missile or projectile, even a small deflection at a high altitude, and thus at a corresponding long distance from the target, may cause a great variation to the impact location away from the intended target area. The deflection will be amplified by the distance traveled along the changed course.

Figure 8:
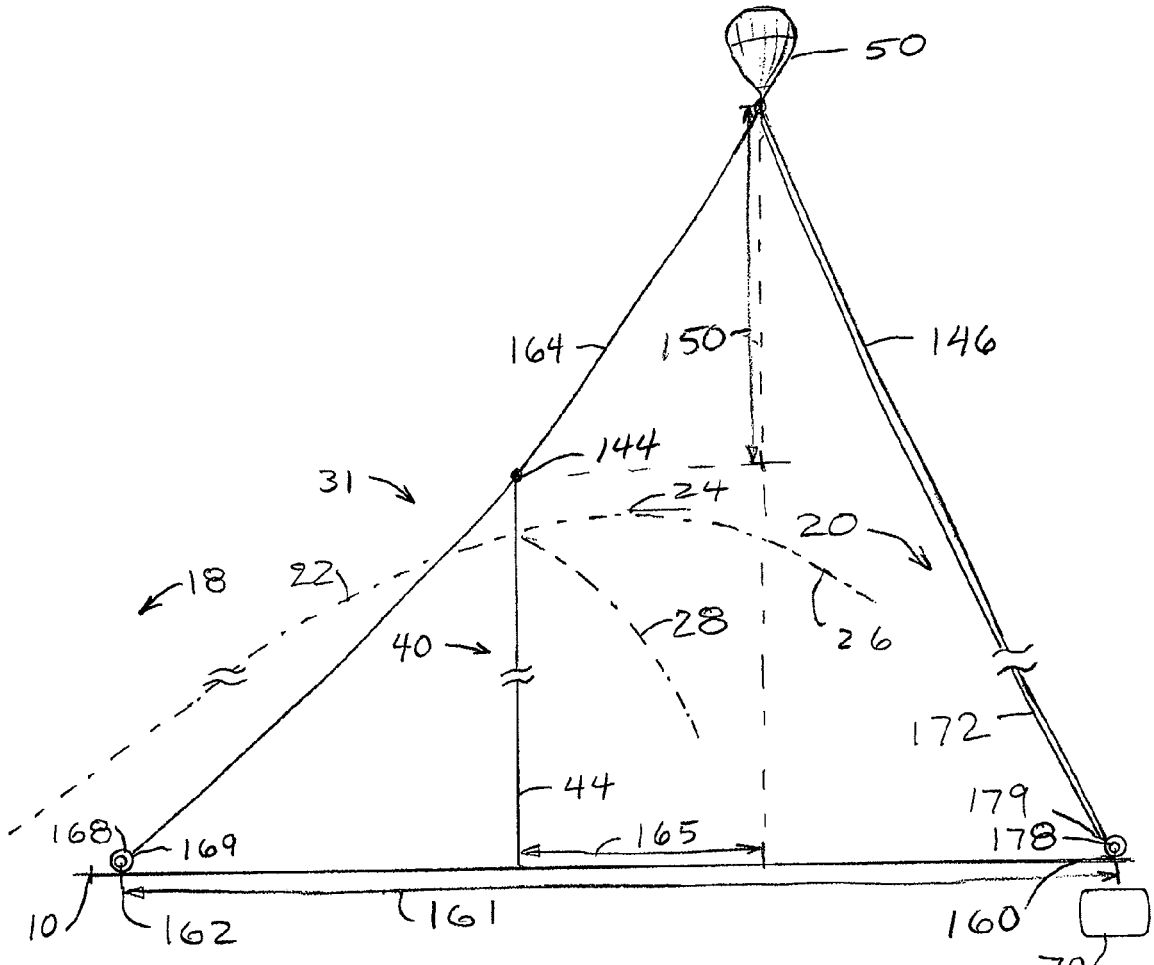
FIG. 8 is a side view of an alternative embodiment showing a defense shield suspended from an angled tether and a support balloon elevated and offset from the defense shield to reduce vulnerability of the support balloons from attack.

According to one or more embodiment the support balloons 50 may be tethered by angled tether lines 164 and positioning tether cords 146 as shown in FIG. 8. The defense shield 31 may be supported from the angled tethers 164 that are angled down from the balloons 50 toward the launch site 18. In this alternative embodiment the support balloons 50 are elevated above the top 144 of the shielding nets 44 and offset a distance 165 from the defense shield 40 away from the border 10 so that the balloons 50 are less vulnerable to attack from the launch site 18 or otherwise from over the border 10.

In one or more embodiments, as shown in FIG. 8, angled tether line 164 is connected to the offset anchor 162. In one embodiment this anchoring connection may be through a biasing device 169, for providing a predetermined amount of tension to the angled tether line 164. For example, such a biasing device 169 might include a reel 168, such as the reel 68 and bias device 68 shown in greater detail in FIG. 3. In FIG. 8, the offset anchor 162 may be spaced an offset distance 161 from the main ground anchor 160 toward the border 10 and toward the missile launch area 18. The balloons 50 are also anchored at a main ground anchor 160 through a tether cord 146 that will also form an angle with respect to the ground due to the buoyancy of the balloon 50 and the tension in the tether line 164 and the tether cord 146. The reel 168 may be rotationally biased by the bias device 169 toward the offset anchor 162 to adjust for supporting the weight of the net sheets 44 that form the shielding screen 40, and for wind forces. Similarly the tether cord 146 may be attached to the main anchor 160 with a reel 178 and biasing device 179. The tension in the tether cords 146 and in the angled tether lines 164 pull in each direction against the buoyancy of the balloons 50 so that the balloon position is determined. The net sheets 44 attached to the angle tether cord 164 at a position so that the net sheets are suspended to a sufficient height. For example, so that the tops 144 of the shielding nets 44 are at or above the expected maximum altitude 24 of an expected trajectory 22 of missiles to be defended against.

In one or more embodiments, the amount of tension in tether line 164 and tether cords 146 may be predetermined so that the impact of a missile with the shielding screen 40 is accommodated with give, and then the net sheet 44 is returned by biasing force to its shielding position. Thus, the angled tether line 164 may be anchored at a position towards the launch area 18 with the net screen 44 position spaced a short distance back from the border 10 and towards the target area 20 to be shielded. This arrangement facilitates supporting the shielding screen 40 in the direction of impact by projectiles. The biasing as by coil tension is thus provided in the direction that the projectiles are coming from, so that when the projectile hits the material or net sheets 44, it gives at a certain calibrated rate to slow down the missile as the shielding screen deforms and moves in the direction of the impact. The bias tension moves the net sheet 44 back to a shielding position. The balloons 50 are further back toward the target area 20, further away from the launch site 18, and at a higher altitude than the top 144 shielding screen 40, for example by a distance 150, so that the balloons 50 are more difficult to shoot down.

According to one or more embodiments, there may be two angled tether lines 164 for each sheet, and the net sheets 44 may be secured at the same distance along the tether lines toward the balloons 50. The balloons may be replenished with fuel for an on board hot air gas burner or with lighter than air gas from a source 70 and along a conduit 172 that also may extend along tether cord 146. Because of the angle of tether cord 146, the conduit 172 is also less vulnerable to attack. The angled tether cords 146 may also be attached to tensioning or biasing devices 179 that may provide an amount of tension that appropriately counter-balances the tension in the angled tether lines 164 so that they play out or retract at a certain rate or provide a desired amount of give, whether it is through a coiled spring system, or one or more mechanisms that control or calibrate the "give" to a desired rate to slow down, deflect, or stop the projectile given its expected speed, weight, force, configuration, etc. and then return the nets 44 to their desired shielding positions.

The most sophisticated national defense systems including the US military are using their AWACS and cruise missiles to look for and knock down sophisticated guided missiles. They are not looking for and shooting down low tech unguided missiles, projectiles, and mortars. The present defense shield could be set up around a base, town, or attack target of any kind to facilitate defense against the low technology attacks that are not cost effective to defend using more sophisticated systems. This shield could be deployed and retracted at will. In one variation it could be deployed quickly by the panels being shot up, with the balloons deploying when the panels reach their intended height as determined by the length of the tethers. In such an embodiment, a compressed lighter-than-air gas may be used that deploys the balloon when the panel reaches its intended height and the tether stops it.

A variation of the netting material could be employed to deflect bullets, for example at selected altitudes, (the material might need to be a close weave or a "solid" fabric material). Such material might not have to be held as high up by the balloons because the impact of a bullet falling at terminal velocity from a high altitude is not as devastating as a lower trajectory and thus higher velocity bullet that might reach the target area. In appropriate circumstances a balloon-supported bullet projectile shield might be easier and faster to deploy than erecting a wall on the ground. It could be considered as a highly portable wall of fabric that may be helpful as a defense of a target area.

While the invention has been described with respect to a limited number of embodiments, and the discussion has focused on lighter-than-air supported defense shields along borders, those skilled in the art, having benefit of this disclosure, will appreciate that other embodiments can be devised which do not depart from the scope of the invention as disclosed herein. For example, lighter-than-air supported defense shields may be movable as with ships or may be otherwise guided for deployment at different locations. For example, the defense shield may be guided to a missile launch area to intercept missiles directed to a target area, or such a defense shield might be guided to effectively surround such a launch site to intercept, deflect, and "contain" missiles from leaving the launch site and reaching a target area to be protected and these and other embodiments may also benefit from certain aspects of the present invention alone or in combinations with the various other aspects of the present invention. Accordingly, the scope of the invention should be broadly interpreted to the full extent to which applicant is entitled and limited only by the attached claims.

What is claimed is:

1. A method for deflecting airborne missiles, mortars, and other projectile ordnance launched along a trajectory from a ground launch location across a border toward a ground target location, the method comprising:

tethering a plurality of lighter-than-air balloons from a plurality of anchoring positions adjacent to and spaced apart along the border between the launch location and the target location; wherein the lighter-than-air balloons are buoyed on tethers upward to a height above the expected trajectory of the launched missile at the border;

suspending a plurality of missile deflecting nets comprising interwoven strands forming a mesh along the tethers from the plurality of lighter-than-air balloons, wherein the plurality of deflecting nets extend from above the missile trajectory to below the missile trajectory and wherein the plurality of deflecting nets are connected adjacent to one another to form a substantially continuous deflection shield supported by the tethered lighter-than-air balloons above and along the border between the launch location and the target location; wherein, suspending the plurality of net sheets positioned adjacent to one another to form the deflection shield so that the deflection shield extends substantially continuous along and above the border between the launch location and the target location comprises suspending one or more net sheets spaced behind the other net sheets in the direction of the missile movement so that a plurality of net sheets will engage a missile along the expected trajectory of the missile and wherein the defense shield is capable of engaging and deflecting missiles.

2. A method for deflecting missiles launched along an expected trajectory from a ground launch area across a border to be defended toward a ground target area, the method comprising:

tethering a plurality of lighter-than-air balloons from a plurality of ground anchors so that the balloons are positioned spaced apart, adjacent to, along and above the border to be defended between the launch area and the target area; and buoying the lighter-than-air balloons upward to a height at or above the expected trajectory of the launched missiles at the border; wherein tethering the plurality of lighter-than-air balloons from a plurality of ground anchors, comprises forming tether cords of high strength lightweight material and fastening the tether cords between the balloons and the ground anchors;

suspending a defense shield from the plurality of tethered lighter-than-air balloons, wherein the defense shield extends generally vertically in a range of heights covering the expected missile trajectory and wherein the defense shield is capable of engaging and deflecting missiles; wherein, suspending the defense shield comprises suspending a plurality of net sheets positioned adjacent to one another to form the defense shield so that the defense shield extends substantially continuous along and above the border between the launch location and the target location comprises suspending one or more net sheets spaced behind the other net sheets in the direction of the missile movement so that a plurality of net sheets will engage a missile along the expected trajectory of the missile, and wherein buoying of the balloons upward comprises providing the balloons with an amount of lift force that exceeds the total weight of the tether cords and the net sheets.

3. A method for deflecting missiles launched along an expected trajectory from a ground launch area across a border to be defended toward a ground target area, the method comprising:

tethering a plurality of lighter-than-air balloons from a plurality of ground anchors so that the balloons are positioned spaced apart, adjacent to, along and above the border to be defended between the launch area and the target area, buoying the lighter-than-air balloons upward to a height at or above the expected trajectory of the launched missiles at the border, and wherein tethering the plurality of lighter-than-air balloons from a plurality of ground anchors, comprises forming tether cords of high strength lightweight material and fastening the tether cords between the balloons and the ground anchors;

suspending a defense shield from the plurality of tethered lighter-than-air balloons, wherein the defense shield extends generally vertically in a range of heights covering the expected missile trajectory, wherein the defense shield is capable of engaging and deflecting missiles, wherein, suspending a defense shield from the plurality of tethered lighter-than-air balloons, comprises forming a plurality of net sheets composed of strands of lightweight, high strength material, suspending the plurality of net sheets positioned adjacent to one another to form the defense shield so that the defense shield extends substantially continuous along and above the border between the launch location and the target location, and wherein suspending the plurality of net sheets positioned adjacent to one another to form the defense shield so that the defense shield extends substantially continuous along and above the border between the launch location and the target location comprises suspending one or more net sheets spaced behind the other net sheets in the direction of the missile movement so that a plurality of net sheets will engage a missile along the expected trajectory of the missile; and buoying of the balloons upward comprises providing the balloons with an amount of lift force that exceeds the total weight of the tether cords and the net sheets.

4. A method for deflecting missiles launched along an expected trajectory from a ground launch area across a border to be defended toward a ground target area, the method comprising:

tethering a plurality of lighter-than-air balloons from a plurality of ground anchors so that the balloons are positioned spaced apart, adjacent to, along and above the border to be defended between the launch area and the target area; and buoying the lighter-than-air balloons upward to a height at or above the expected trajectory of the launched missiles at the border;

suspending a defense shield from the plurality of tethered lighter-than-air balloons, wherein the defense shield extends generally vertically in a range of heights covering the expected missile trajectory and wherein the defense shield is capable of engaging and deflecting missiles;

determining a maximum expected trajectory for missiles of the type to be defended to reach the target area to be defended when launched across the border from the launch area, determining a minimum expected trajectory for missiles of the type to be defended to reach the target area to be defended when launched across the border from the launch area, positioning the balloons at or above the maximum expected trajectory of missiles launched across the border and extending the net sheets from an altitude at or above the maximum expected trajectory of the missiles and down to an altitude at or below a minimum expected trajectory of the missiles that would reach the target area to be defended, and wherein determining the maximum expected trajectory for missiles comprises determining that the maximum expected trajectory will be less than two miles; and determining a minimum expected trajectory for missiles comprises determining that the minimum expected trajectory for reaching the target to be defended will be more than one-half mile; and extending the net sheets from an altitude at or above the maximum expected trajectory of the missiles and down to an altitude at or below a minimum expected trajectory of the missiles that would reach the target area to be defended comprises extending the net sheets vertically for a distance of about one and one-half miles (1.5 miles) from a maximum height of about 2 miles above the ground down to about 0.5 mile above the ground.

5. A method for deflecting missiles launched along an expected trajectory from a ground launch area across a border to be defended toward a ground target area, the method comprising:

tethering a plurality of lighter-than-air balloons from a plurality of ground anchors so that the balloons are positioned spaced apart, adjacent to, along and above the border to be defended between the launch area and the target area; and buoying the lighter-than-air balloons upward to a height at or above the expected trajectory of the launched missiles at the border;

suspending a defense shield from the plurality tethered lighter-than-air balloons, wherein the defense shield extends generally vertically in a range of heights covering the expected missile trajectory and wherein the defense shield is capable of engaging and deflecting missiles; wherein, buoying of the balloons upward comprises providing the balloons with an amount of lift force that exceeds the total weight of the tether cords, the net sheets, and forces expected based upon prevailing wind at the border between the launch location and the target location; and tethering the plurality of lighter-than-air balloons from a plurality of ground anchors, comprises forming tether cords of high strength lightweight material and fastening the tether cords between the balloons and the ground anchors, forming angled tether lines of high strength lightweight material and fastening the tether lines between the net sheets and offset ground anchors positioned adjacent to the border up wind from the main ground anchors so that net sheets are held in position against the prevailing wind.

6. The method for deflecting missiles of claim 5, wherein tethering the plurality of lighter-than-air balloons from a plurality of ground anchors further comprises biasing the angled tether lines with a predetermined amount of bias tension so that the net sheets deform, move and return to position against wind resistance.

7. A method for deflecting missiles launched along an expected trajectory from a ground launch area across a border to be defended toward a ground target area, the method comprising:

tethering a plurality of lighter-than-air balloons from a plurality of ground anchors so that the balloons are positioned spaced apart, adjacent to, along and above the border to be defended between the launch area and the target area; and buoying the lighter-than-air balloons upward to a height at or above the expected trajectory of the launched missiles at the border;

suspending a defense shield from the plurality of tethered lighter-than-air balloons, wherein the defense shield extends generally vertically in a range of heights covering the expected missile trajectory and wherein the defense shield is capable of engaging and deflecting missiles; and wherein, tethering the plurality of lighter-than-air balloons from a plurality of ground anchors, comprises forming tether cords of high strength lightweight material and fastening the tether cords between the balloons and the ground anchors, forming angled tether lines of high strength lightweight material and fastening the tether lines between the net sheets and offset ground anchors positioned closer to the border and closer to the launch area than the main ground anchors so that net sheets are held in position against the impact force of missiles launched from the launch area.

8. The method for deflecting missiles of claim 7, wherein tethering the plurality of lighter-than-air balloons from a plurality of ground anchors that further comprises biasing the angled tether lines with a predetermined amount of bias tension so that the net sheets deform, move and return to position against missile impact force.

9. A method for deflecting missiles launched along an expected trajectory from a ground launch area across a border to be defended toward a ground target area, the method comprising:

tethering a plurality of lighter-than-air balloons from a plurality of ground anchors so that the balloons are positioned spaced apart, adjacent to, along and above the border to be defended between the launch area and the target area; and buoying the lighter-than-air balloons upward to a height at or above the expected trajectory of the launched missiles at the border;

suspending a defense shield from the plurality of tethered lighter-than-air balloons, wherein the defense shield extends generally vertically in a range of heights covering the expected missile trajectory and wherein the defense shield is capable of engaging and deflecting missiles; and comprising controlling the buoyancy of the lighter-than-air balloons by supplying controlled amounts of lighter-than-air gas from the ground to the balloons through a conduit.

10. A method for deflecting missiles launched along an expected trajectory from a ground launch area across a border to be defended toward a ground target area, the method comprising:

tethering a plurality of lighter-than-air balloons from a plurality of ground anchors so that the balloons are positioned spaced apart, adjacent to, along and above the border to be defended between the launch area and the target area; and buoying the lighter-than-air balloons upward to a height at or above the expected trajectory of the launched missiles at the border;

suspending a defense shield from the plurality of tethered lighter-than-air balloons, wherein the defense shield extends generally vertically in a range of heights covering the expected missile trajectory and wherein the defense shield is capable of engaging and deflecting missiles; and comprising controlling the buoyancy of the lighter-than-air balloons by controlling an onboard hot air burner and re-supplying the onboard hot air burner with fuel from the ground to the balloon through a conduit.

11. A method for deflecting missiles launched along an expected trajectory from a ground launch area across a border to be defended toward a ground target area, the method comprising:

tethering a plurality of lighter-than-air balloons from a plurality of ground anchors so that the balloons are positioned spaced apart, adjacent to, along and above the border to be defended between the launch area and the target area; and buoying the lighter-than-air balloons upward to a height at or above the expected trajectory of the launched missiles at the border;

suspending a defense shield from the plurality of tethered lighter-than-air balloons, wherein the defense shield extends generally vertically in a range of heights covering the expected missile trajectory and wherein the defense shield is capable of engaging and deflecting missiles; and wherein, tethering the plurality of lighter-than-air balloons from a plurality of main ground anchors, comprises forming tether cords of high strength lightweight material and fastening the tether cords between the balloons and the ground anchors, forming angled tether lines of high strength lightweight material and fastening the tether lines between the net sheets and offset ground anchors positioned adjacent to the border and space apart form the main anchors so that the tether cords and tether lines are angle relative to each other upward to the buoyed balloons;

suspending the net sheets comprises suspending the net sheets from the angled tether cords between the launch site and the balloons so that the balloons are at a higher altitude and spaced back from the net sheets toward the target area; and buoying of the balloons upward comprises providing the balloons with an amount of lift force that exceeds the total weight of the tether cords, the angled tether lines, the net sheets suspended from the angled tether lines.

12. A device for deflecting missiles launched along an expected trajectory from a ground launch area across a border to be defended toward a ground target area, comprising:

a plurality of spaced apart ground anchors secured to the ground positioned spaced apart, adjacent to, along the border to be defended between the launch area and the target area;

a plurality of lighter-than-air balloons tethered from the plurality of spaced apart ground anchors so that the lighter-than-air balloons are buoyed upward and tethered at positions spaced apart, adjacent to, along and above the border to be defended between the launch area and the target area, wherein the lighter-than-air balloons are buoyed upward to a height at or above the expected trajectory of the launched missiles at the border;

a defense shield capable of engaging and deflecting missiles suspended from the plurality of tethered lighter-than-air balloons, wherein the defense shield, comprising a plurality of connected nets having interwoven strands forming a mesh, extends generally vertically below the lighter-than-air balloons in a range of heights corresponding to expected missile trajectories that would allow the missiles to reach the target area when launched from the launch area, so that the missiles launched from the launch area along the trajectories to the target area are engaged and deflected by the defense shield; and a plurality of tether cords of high strength lightweight material and fastened between the lighter-than-air balloons and the ground anchors; and wherein the defense shield suspended from the plurality of tethered lighter-than-air balloons, comprises a plurality of net sheets composed of strands of lightweight, high strength material, the plurality of net sheets positioned adjacent to one another overlapping at least partially along vertical edges and suspended from the plurality of lighter-than-air balloons to form the defense shield that extends substantially continuously along and above the border between the launch area and the target area; and wherein the lighter-than-air balloons comprise a volume for holding hot air or other lighter than ambient air gases with an amount of lift force that exceeds the total weight of the tether cords and the net sheets.

13. The device for deflecting missiles of claim 12, comprising the plurality of net sheets positioned adjacent to one another to form the defense shield so that the defense shield extends substantially continuous along and above the border between the launch location and the target location comprises suspending one or more reinforcement net sheets spaced behind, in the direction of the missile movement, the plurality of net sheets positioned adjacent to one another so that one of the plurality of net sheets and one or more of the reinforcement net sheets will engage a missile launched along the expected trajectory of the missile from the launch area to the target area.

14. The device for deflecting missiles of claim 12, the plurality of net sheets comprise strands of lightweight, high strength material formed into an interwoven net having spaces between the strands sufficiently close so that the missiles will be engaged by the strands of the net.

15. The device for deflecting missiles of claim 14, the plurality of net sheets comprise strands of lightweight, high strength material formed into an interwoven net having spaces between the strands sufficiently far apart so that wind resistance for the net sheets is low and at most the wind resistance is less than the amount of lift force of the balloons that exceeds the total weight of the tether cords and net sheet.

16. The device for deflecting missiles of claim 12, wherein the lighter-than-air balloons are positioned at an altitude equal to or greater than the height of the maximum expected trajectory of missiles launched across the border and wherein the net sheets extend below the lighter-than-air balloons from an altitude equal to or greater than the height of the maximum expected trajectory of the missiles and down to an altitude less than or equal to a minimum expected trajectory height of the missiles that would reach the target area to be defended.

17. The device for deflecting missiles of claim 16, wherein the maximum expected trajectory will be an altitude corresponding to a height equal to or less than two miles above ground, the minimum expected trajectory for reaching the target to be defended will be an altitude corresponding to a height more than one-half mile above ground level, and the net sheets extend a vertical distance of about one and one-half miles (1.5 miles) from a maximum height of about 2 miles above the ground down to a minimum height of about 0.5 mile above the ground.

18. The device for deflecting missiles of claim 12, comprising a plurality of offset ground anchors positioned adjacent to the border up wind, as determined according to a prevailing wind direction, from the main ground anchors; and a plurality of angled tether lines comprised of high strength lightweight material fastened between the net sheets and the offset ground anchors so that the net sheets are held in position against the prevailing wind.

19. The device for deflecting missiles of claim 18, comprising a plurality of biasing devices connected to the angled tether lines, the biasing devices capable of applying a predetermined amount of bias tension to the angled tether lines so that the net sheets are allowed to deform and move in response to increased wind and to return to position in response to decreased wind.

20. The device for deflecting missiles of claim 12, comprising a plurality of offset ground anchors positioned closer to the border and closer to the launch area than the main ground anchors so that net sheets are held in position against the impact force of missiles launched from the launch area.

21. The device for deflecting missiles of claim 20, comprising a plurality of biasing devices attached to the angled tether lines capable of applying a predetermined amount of bias tension to the angled tether lines connected to the net sheets so that the net sheets deform and move in response to missile impact force and return to position after the missile is deflected.

22. The device for deflecting missiles of claim 12, comprising a buoyancy control including a supply of lighter-than-air gas on the ground, a conduit from the supply to the balloon for transmitting lighter-than-air gas from the ground to the balloons, and a control valve operatively connected to the conduit for allowing controlled amounts of lighter-than-air gas from the ground supply through the conduit to the balloons to control the buoyancy of the balloons.

23. The device for deflecting missiles of claim 12, wherein the lighter-than-air balloons comprise hot air balloons and comprising an onboard hot air burner, remote controls for the onboard hot air burners for operating the burner to control the buoyancy of the lighter-than-air balloon, a supply of fuel for the burner at the ground and a conduit for supplying the onboard hot air burner with fuel from the ground to the balloon though the conduit.

24. The device for deflecting missiles of claim 12, comprising:

a plurality of tether cords of high strength lightweight material and fastened between the lighter-than-air balloons and main ground anchors; and a plurality of angled tether lines of high strength lightweight material and fastened between the lighter-than-air balloons and offset ground anchors positioned a spaced apart distance from the main ground anchors toward the launch site, and wherein the defense shield is suspended from the plurality of angled tether lines spaced a distance along the angled tether lines down from the lighter-than-air balloons, so that the balloons are positioned above and toward the target area from the suspended defense shield, and wherein the lighter-than-air balloons comprise a volume for holding hot air or other lighter than ambient air gases with an amount of lift force that exceeds the total weight of the tether cords, the angled tether lines, and the defense shield.

* * * * *